US008056587B2

(12) United States Patent
Fuchs

(10) Patent No.: US 8,056,587 B2
(45) Date of Patent: Nov. 15, 2011

(54) FABRIC, IN PARTICULAR FOR TEXTILE STRUCTURES AND/OR COVERINGS

(75) Inventor: Wolfgang Fuchs, Diepoldsau (CH)

(73) Assignee: Sefar AG (CH)

( * ) Notice: Subject to any disclaimer, the term of this patent is extended or adjusted under 35 U.S.C. 154(b) by 211 days.

(21) Appl. No.: 12/301,917

(22) PCT Filed: May 25, 2007

(86) PCT No.: PCT/EP2007/004684

§ 371 (c)(1),
(2), (4) Date: Nov. 21, 2008

(87) PCT Pub. No.: WO2007/140893

PCT Pub. Date: Dec. 13, 2007

(65) Prior Publication Data

US 2010/0233455 A1 Sep. 16, 2010

(30) Foreign Application Priority Data

Jun. 6, 2006 (DE) ..... 20 2006 008 868 U

(51) Int. Cl.
*D03D 15/10* (2006.01)
*D03D 15/00* (2006.01)
*D03D 25/00* (2006.01)

(52) U.S. Cl. ..... 139/420 A; 139/383 R; 139/420 R; 139/426 R

(58) Field of Classification Search ..... 139/383 R, 139/420 R, 426 R, 420 A
See application file for complete search history.

(56) References Cited

U.S. PATENT DOCUMENTS

| | | | | |
|---|---|---|---|---|
| 2,906,567 | A * | 9/1959 | Runton et al. | 384/191.2 |
| 3,804,479 | A * | 4/1974 | Butzow et al. | 384/300 |
| 4,443,511 | A | 4/1984 | Worden et al. | |
| 5,314,446 | A * | 5/1994 | Hunter et al. | 606/231 |
| 6,132,866 | A * | 10/2000 | Nelson et al. | 428/359 |
| 6,159,239 | A * | 12/2000 | Greenhalgh | 623/1.13 |
| 6,164,339 | A * | 12/2000 | Greenhalgh | 139/1 R |
| 6,511,927 | B1 | 1/2003 | Ellis et al. | |
| 2001/0000188 | A1 * | 4/2001 | Lenker et al. | 623/1.13 |
| 2001/0008937 | A1 * | 7/2001 | Callegaro et al. | 536/53 |
| 2002/0079610 | A1 * | 6/2002 | Uy et al. | 264/211.12 |
| 2002/0155287 | A1 * | 10/2002 | Nelson et al. | 428/359 |
| 2002/0189701 | A1 * | 12/2002 | Berger et al. | 139/383 R |
| 2005/0215154 | A1 * | 9/2005 | Rector et al. | 442/180 |
| 2008/0032837 | A1 * | 2/2008 | Unruh et al. | 474/143 |

FOREIGN PATENT DOCUMENTS

| | | |
|---|---|---|
| DE | 2124031 | 11/1972 |
| EP | 0962313 A1 | 12/1999 |
| JP | 01139839 | 6/1989 |
| JP | 08294982 | 11/1996 |

OTHER PUBLICATIONS

International Search Report for PCT/EP2007/004684—mailed Aug. 27, 2007.

(Continued)

*Primary Examiner* — Bobby Muromoto, Jr.
(74) *Attorney, Agent, or Firm* — Studebaker & Brackett PC; Donald R. Studebaker

(57) ABSTRACT

The fabric for textile structures and/or coverings, consisting of warp threads and weft threads of PTFE-yarn, in which the number of warp threads is at least approximately twice the number of weft threads. A method for producing a fabric, in which during the weaving through the warp threads at least two parallel extending individual threads are led simultaneously through a shed of the warp threads.

10 Claims, 1 Drawing Sheet

OTHER PUBLICATIONS

Agnes Wittman-Regis; "International Preliminary Report on Patentability"; Jan. 13, 2009, PCT/EP2007/004684.

Agnes Wittman-Regis; "Written Opinion of the International Searching Authority"; Jan. 13, 2009, PCT/EP2007/004684.

* cited by examiner

FABRIC, IN PARTICULAR FOR TEXTILE STRUCTURES AND/OR COVERINGS

The invention relates to a fabric, in particular for textile structures and/or coverings, consisting of warp threads and weft threads of PTFE-yarn The invention further relates to a method for producing a fabric.

It is known to make use of PTFE-yarns (polytetrafluoroethylene yarns) in the production of fabrics.

The object of the invention is to provide a PTFE-fabric which has, especially in the uncoated condition, a particularly high water tightness accompanied by a high tensile strength. Furthermore, the object of the invention is to provide a method for producing a fabric, in particular a PTFE-fabric that has these properties.

In accordance with the invention the object is solved on the one hand in that the number of warp threads is at least approximately twice the number of weft threads. It has proved that a particularly good water tightness can be achieved with such a configuration.

A further aspect of the invention resides in the fact that the number of warp threads amounts to 100 to 125 threads/cm, in particular 115+/−3 threads/cm and/or that the number of weft threads amounts to 50 to 80 threads/cm, in particular 57+/−3 threads/cm.

Tests have shown that with these thread densities a water tightness of an 8 cm water column and higher can be achieved without coating. Due to the comparatively high number of threads it is possible to attain comparatively small pores which results in the good water tightness. In addition, due to the comparatively high number of warp threads an especially high tensile strength can be achieved. The comparatively high number of weft threads allows for an increase in the machine output during weaving which is accompanied by an increase in operational economy.

Fabrics according to the invention can be employed in architecture, more particularly in outdoor architecture. In particular, such fabrics can be put into use for parasol and awning constructions, large tents, sun-blind awnings, foldable shades, tent-type constructions and/or plane load-bearing structures. With the fabric according to the invention it is possible to realize parasol constructions having the size of 25 m×25 m for example.

In accordance with the invention a PTFE-yarn is employed that is particularly inert and UV-stable from a chemical standpoint and is therefore especially suitable for outdoor applications.

It is preferred according to the invention that the warp threads consist of a single yarn and/or that the titer of the warp threads chosen is low. According to the invention the titer of the warp threads can, for instance, amount to 350 to 370 dtex, in particular to approximately 360 dtex. In the case of a low mass density of the yarn an especially soft touch is brought about.

Moreover, it is of advantage that the weft threads consist of a single yarn, whose titer is preferably higher than the titer of the warp threads, for best suitability it is approximately twice as high. More particularly, the titer of the weft threads can amount to 640 to 660 dtex, by preference to approximately 650 dtex. Provision can also be made for a titer that amounts approximately to at least 720 dtex.

Alternatively, provision can be made for the weft threads to consist of a plied yarn, in particular having two individual threads. In such case it is suitable for the titer of the weft threads to correspond to the titer of the warp threads. For instance the titer of the weft threads can amount to 350 to 370 dtex, by preference to approximately 360 dtex. In particular, the titer of the individual threads can have the stated values. A plied yarn can be understood in particular as a yarn consisting of several individual threads that are not twined but extend at least approximately parallel to each other.

Compared to a twined yarn the individual threads of a plied yarn normally require slightly more space in the fabric structure so that when a plied yarn is used the resultant fabric may be slightly thicker and/or especially soft, too. In addition, plied yarns permit a higher colour flexibility as compared to twined threads.

If a plied yarn with two individual threads is used as weft thread, the number of individual threads per length unit can amount to twice the number of weft threads. For instance if 50 to 65 wefts per cm are provided, i.e. if the number of weft threads of the plied weft threads amounts to 50 to 65 threads/cm, the number of individual weft threads amounts to 100 to 130 threads/cm.

Instead of a plied yarn, in which the threads are not twisted or to an insignificant extent only, it is basically possible to use a twined yarn, too. In particular, the yarn can have in this case two individual threads whose titer can amount to 350 to 370 dtex for example, preferably 360 dtex. In comparison to a single yarn that has the same overall titer a greater surface and therefore an improved water repellence is achieved by making use of comparatively thin individual threads in a twined yarn or in a plied yarn, which may prove to be of particular advantage in outdoor architectural applications.

The touch of the fabric can be improved by a slack twisting of the weft threads and/or warp threads.

In outdoor architectural applications it is especially advantageous that the weight of the fabric amounts to at least 900 $g/m^2$. For instance a fabric weight of approximately 1000 $g/m^2$, preferably amounting to approximately 2000 $g/m^2$ can be provided.

A particularly soft touch and a good water tightness can be achieved in that the fabric weave is a Panama weave or a twill weave. By preference, a Panama 6/6 weave can be provided. More particularly, a 4-thread Panama 6/6 weave with the consecutive number 4, i.e. a P 6/6 (4) 4 weave can be provided.

With regard to the tensile strength of the fabric it is especially advantageous for the fabric to be woven in a multi-layered, in particular in a double-layered manner. When having a double-layered fabric structure in connection with the comparatively high number of warp threads according to the invention a tensile strength of more than 5000 N/5 cm could be attained.

The purity of the fabric can be improved in that it is treated in at least one bath after weaving. By preference, the fabric is washed in an acid bath, an alkaline bath and/or an oxidizer bath. For best suitability the fabric is washed successively in all three compartments, in which case the order provided can be first the acid bath, then the alkaline bath and finally the oxidizer bath. The oxidizer bath is for example a hydrogen peroxide bath that is a particularly effective and economic oxidizing agent. Advantageously, the chemical baths are heated and in order to attain an especially high effectiveness they suitably have an increased temperature ranging e.g. at approximately 80° C. If provision is made for a washing in chemical baths, it is of advantage that a rinsing in pure water is provided at the end of the washing. Such a rinsing can also be provided in-between the individual baths.

To counteract a slipping of fabric seams, i.e. to reach a particularly high seam stability, it may be advantageous for the warp threads to lie at least approximately in one plane.

In addition, it is of advantage that white warp threads are used and that at least a part of the weft threads is coloured. In particular, in the fabric structure coloured weft threads can be provided periodically, while the remaining weft threads are white. For instance every fifth or tenth weft thread can be coloured. As a result, a coloured fabric structure can be achieved in an especially simple and economic way. Since the coloured threads are provided according to this embodiment in one thread system only, the embodiment permits a particularly easy alignment of the fabric in subsequent processing steps. Furthermore, an especially harmonious and at the same time uniform appearance of the fabric is achieved.

With the fabric according to the invention a high mechanical stability, especially a wind resistance, a high aging resistance, especially UV-stability and/or good shading characteristics can be achieved.

A method according to the invention for producing a fabric comprising warp threads and weft threads is characterized in that during the weaving through the warp threads at least two parallel extending individual threads are led simultaneously through a shed of the warp threads.

A fundamental idea of the method according to the invention can be seen in the fact that with each weft at least two, by preference precisely two individual threads are inserted parallel into a shed. Hence, according to this aspect of the invention a plied yarn is used in particular as weft thread so that the advantages set out in this connection can be realized. Since the two individual threads are inserted simultaneously, the same machine output, i.e. weft insertion capacity, can be realized in comparison to a twined yarn.

During weaving it is also possible to provide several sheds at a time so that several weft threads, at least one of which is designed in a plied manner, can be inserted simultaneously. As a result, the productivity can be enhanced further.

When carrying out the method according to the invention preferably 50 to 65 wefts per cm are provided. However, since several individual threads are inserted simultaneously per weft, the number of individual weft threads is correspondingly higher.

The method in accordance with the invention is particularly suitable for the production of fabrics consisting of PTFE-yarn. By preference, the method is provided for producing the fabric according to the invention.

To carry out the method according to the invention it is suitable to use a weaving machine having at least two yarn carriers and at least two pre-winding devices for the two individual threads of the weft thread.

In the following the invention will be described in greater detail by way of a preferred embodiment that is explained schematically in the accompanying drawing.

Figure 1:
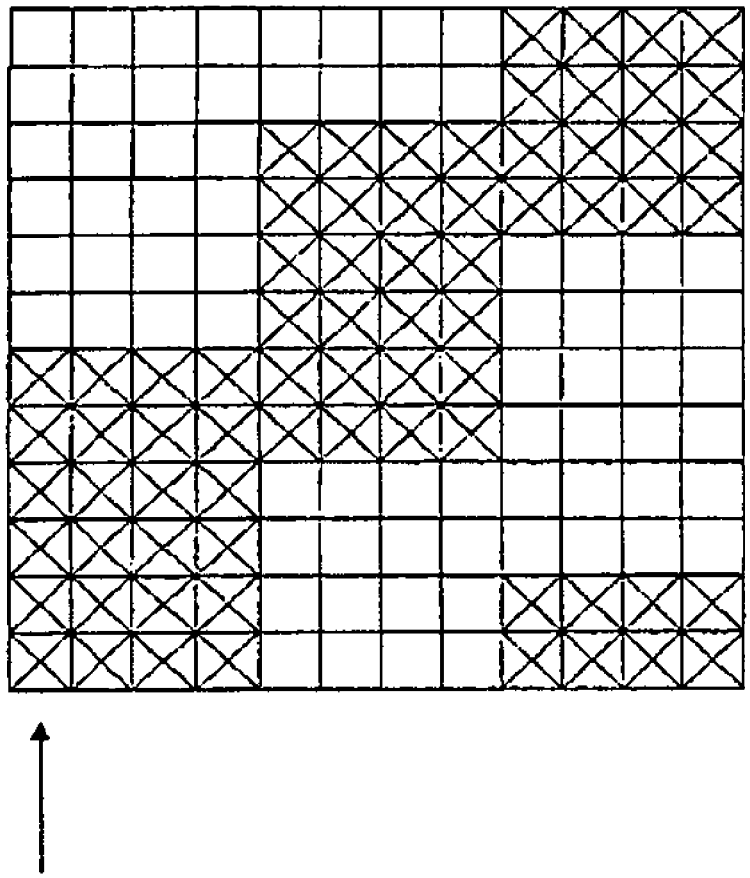
FIG. 1 shows a possible pattern repeat for a fabric according to the invention, with the arrow indicating the warp direction. According to FIG. 1 a 4-thread Panama 6/6 (4) weave is provided.

The invention claimed is:

1. Fabric for textile structures and/or coverings, consisting of warp threads and weft threads of PTFE-yam, wherein the number of warp threads is at least approximately twice the number of weft threads, wherein the warp threads consist of a single yam and the weft threads consist of a plied yarn with two individual threads.

2. Fabric according to claim 1, consisting of warp threads and weft threads of PTFE-yam, wherein the number of warp threads amounts to 100-125 threads/cm and/or in that the number of weft threads amounts to 50-65 threads/cm.

3. Fabric according to claim 1, wherein the titer of the warp threads chosen is low.

4. Fabric according to claim 1, wherein the weft threads consist of a single yarn, whose titer is higher than the titer of the warp threads, by preference approximately twice as high.

5. Fabric according to claim 1, wherein the weft threads and/or the warp threads are twisted.

6. Fabric according to claim 1, wherein the weight of the fabric amounts to at least 900 $g/m^2$.

7. Fabric according to claim 1, wherein the fabric weave is a Panama weave or a twill weave.

8. Fabric according to claim 1, wherein it is woven in a multilayered, or in a double-layered manner.

9. Fabric according to claim 1, wherein it is washed in an acid bath, an alkaline bath and an oxidizer bath.

10. Method for producing a fabric comprising warp threads and weft threads according to claim 1, wherein during the weaving through the warp threads at least two parallel extending individual threads are led simultaneously through a shed of the warp threads.

* * * * *